US005706655A

United States Patent [19]

Kojima et al.

[11] Patent Number: 5,706,655

[45] Date of Patent: Jan. 13, 1998

[54] THIN-WALLED DOUBLE PIPE EXHAUST MANIFOLD

[75] Inventors: Takashi Kojima; Yasuo Fukae, both of Tokyo, Japan

[73] Assignee: Calsonic Corporation, Tokyo, Japan

[21] Appl. No.: 452,122

[22] Filed: May 26, 1995

[30] Foreign Application Priority Data

May 27, 1994 [JP] Japan ..... 6-115061

[51] Int. Cl.[6] ..... F01N 7/10

[52] U.S. Cl. ..... 60/322; 60/323

[58] Field of Search ..... 60/322, 323

[56] References Cited

U.S. PATENT DOCUMENTS

| | | | |
|---|---|---|---|
| 5,349,817 | 9/1994 | Bekkering | 60/322 |
| 5,419,127 | 5/1995 | Moore | 60/322 |

FOREIGN PATENT DOCUMENTS

| | | | |
|---|---|---|---|
| 3326260 | 2/1985 | Germany | 60/322 |
| 3436982 | 4/1986 | Germany | 60/322 |
| 1-280616 | 11/1989 | Japan . | |
| 2-72322 | 6/1990 | Japan . | |
| 3-115719 | 5/1991 | Japan . | |

*Primary Examiner*—Douglas Hart
*Attorney, Agent, or Firm*—Foley & Lardner

[57] ABSTRACT

A thin-walled double pipe exhaust manifold comprises a double pipe consisting of a comparatively thin inner tube and a comparatively thick outer tube, both spaced apart from each other adiabatically through an aperture defined between these tubes. The inner tube is formed with at least one bead portion for relieving thermal stresses induced in the inner tube. To effectively reduce thermal stresses by way of thermal expansion or contraction, the bead portion is provided around each heat spot similarly to the temperature distribution of each heat spot.

11 Claims, 5 Drawing Sheets

THIN-WALLED DOUBLE PIPE EXHAUST MANIFOLD

BACKGROUND OF THE INVENTION

1. Field of the Invention

The present invention relates to a thin-walled double pipe exhaust manifold attached to a cylinder head of an internal combustion engine.

2. Description of the Prior Art

As is generally known, in an exhaust system of internal combustion engines, particularly gasoline engines, a metallic catalytic converter filled with pellets of metal is mounted downstream of an exhaust manifold attached to the cylinder head. To promote a chemical reaction between a catalyst support accommodated in the catalytic converter and the pollutants, i.e., to rapidly activate the catalyst support, the catalyst support must be heated rapidly to a proper temperature enough to provide adequate catalytic action, just after the engine is started. Thus, it is desirable to maintain exhaust gases prevailing in the exhaust pipe upstream of the catalytic converter at high temperatures. The outside wall surface of the exhaust manifold is subjected to the atmosphere, while the inside wall surface of the exhaust manifold is subjected to high-temperature exhaust gases. As a result, the temperature of the inside wall of the exhaust manifold becomes substantially equal to the exhaust-gas temperature. As is well known, the greater the thickness of the exhaust manifold, the greater the thermal capacity of the exhaust manifold. A part of heat of the exhaust gases is transferred to and absorbed by the exhaust manifold, with the result that the exhaust-gas temperature will be lowered remarkably. To avoid such thermal loss, there have been proposed and developed various thin-walled double pipe exhaust manifolds in which an inner tube having a comparatively small thermal capacity is thermally separated from an outer tube surrounding the inner tube through an adiabatic air layer. FIG. 9 shows one such conventional thin-walled double pipe exhaust manifold which is advantageous to rapidly activate the catalytic converter of the exhaust system.

Referring now to FIG. 9, the conventional thin-walled double pipe exhaust manifold 101 includes a thin-walled main double pipe 102, a plurality of thin-walled branch double pipes 103, 104 and 105, and a confluent double pipe 106 connected to a junction 102A located substantially midway of the main pipe 102. The branch pipes 103, 104 and 105 are formed with respective inflow flanges 103A, 104A and 105A at their opening ends, for the purpose of intercommunication between exhaust ports of an engine cylinder head (not shown) and exhaust-gas flow passages defined in the respective branch pipes. The confluent pipe 106 is formed with an outflow flange 107 at its opening end, for the purpose of interconnection between an exhaust pipe (not shown) and the confluent pipe 106. Each of the main pipe 102 and the branch pipes 103, 104 and 105 has a double-pipe structure 111 wherein an inner tube 108 and an outer tube 109 are thermally spaced apart from each other. Defined between the inner and outer tubes 108 and 109 is an aperture 110 serving as an adiabatic layer. The thin-walled branch double pipes 103, 104 and 105 are formed continuously from the respective junctions 102B, 102C and 102D of the thin-walled main double pipe 102. The thickness of the inner tube 108 is so dimensioned as to be less than that of the outer tube 109. The thickness of the inner tube 108 is 0.5 mm, whereas the thickness of the outer tube 109 is 1.5 mm. As a result of the comparatively small thermal capacity of the inner tube 108, heat transferred from the exhaust gases to the inner tube 108 is reduced to the minimum. On such prior art thin-walled double pipe exhaust manifolds, in the event that exhaust gases pass into the respective thin-walled branch double pipes 103, 104 and 105, thermal stresses are locally created in or induced in several inner wall sections at which the exhaust gases are brought into direct contact with them. Great thermal stresses tend to occur at three spots 112, 113 and 114 indicated by the two-dotted line of FIG. 9. These spots 112, 113 and 114 will be hereinafter referred to as "a first heat spot, a second heat spot and a third heat spot", respectively. At each heat spot 112, 113 and 114, since the exhaust gases tend to blow against the heat spot at a given inflow angle between the inner wall surface of the inner tube 108 and a stream line of the incoming exhaust gases entering each branch pipe, there is a greatly increased tendency for thermal stresses to be locally induced repeatedly at the respective heat spot, owing to thermal changes in the exhaust gases. There is a possibility of occurrence of crack at the respective heat spots 112, 113 and 114. On the whole, the conventional thin-walled double pipe exhaust manifold has a relatively inferior durability, as compared with traditional single-pipe exhaust manifolds. Such thermal stresses are produced by changes in the exhaust-gas temperature. For instance, during off-idle operation or medium- or high-speed operation, high-temperature exhaust gases blow against the first, second and third heat spots 112, 113 and 114 of the inner tube 108, thereby causing temperature-rise at and near the respective heat spots 112, 113 and 114. On the other hand, during engine idling or low-speed operation, relatively low-temperature exhaust gases blow against the respective heat spots 112, 113 and 114, and whereby the temperature of the wall surface at and near each heat spot is lowered. In this manner, thermal stresses will repeatedly occur locally at the respective heat spots, owing to repetition of idling operation and off-idling operation. There is a possibility that such thermal stresses induces thermal fatigue. In order to solve the thermal stress problem, Japanese Patent Provisional Publication (Tokkai Heisei) No. 3-115719 teaches the provision of a plurality of concavities formed on a peripheral surface of a single pipe exhaust manifold. FIG. 10 shows a conventional single pipe exhaust manifold disclosed in the Japanese Patent Provisional Publication No. 3-115719. Referring to FIG. 10, the conventional single pipe exhaust manifold 201 includes a main pipe 202, and branch pipes 204, 205 and 206 connected to the main pipe 202 through respective junctions 203A, 203B and 203C. Flanged openings of the branch pipes are communicated with respective exhaust ports of the cylinder head (not shown). To effectively reduce thermal stresses which will be induced in the main pipe 202, a plurality of concavities 207 are formed on the peripheral wall surface of the main pipe 202. In comparison with such a single-pipe exhaust manifold, the inner tube 108 of the previously-noted conventional thin-walled double pipe exhaust manifold 101 could be remarkably affected by changes in exhaust-gas temperature. In other words, the magnitude of thermal stress produced on the inner tube 108 of the thin-walled double pipe exhaust manifold 101 is great, as compared with that produced on the inner wall of the single-pipe exhaust manifold 201. The heat spots 112, 113 and 114 of the thin-walled double pipe exhaust manifold 101 are formed substantially at the same positions as heat spots of the single pipe exhaust manifold 201. The temperature gradient of the inner tube 108 of the thin-walled double pipe exhaust manifold 101 is essentially constant in a direction normal to the wall surface of the inner tube, since the thickness of the inner tube 108 is comparatively thin and additionally the aperture 110 functions as an adiabatic layer. Therefore, the temperature of the inner tube 108 becomes substantially equal to the temperature of exhaust gases flowing therethrough, irrespective of a great temperature difference between an ambient temperature and the exhaust-gas temperature. In other words, the inner tube 108 of the thin-walled double pipe exhaust manifold 101 tends to expand or contract sensitively in response to changes in the exhaust-gas temperature. On the other hand, the shown single-pipe exhaust manifold 201 has a comparatively great temperature gradient in a direction normal to the wall surface of the single main pipe 202. On the whole, the temperature of the main pipe 202 itself is maintained at a lower level than the exhaust-gas temperature. For instance, suppose the exhaust-gas temperature changes from 900° C. down to 700° C. In this case, the temperature of the inner tube 108 of the thin-walled double pipe exhaust manifold 101 may also vary from 900° C. to 700° C. in such a manner as to directly reflect the changes in the exhaust-gas temperature. On the other hand, in case of the exhaust-gas temperature of 900° C., the temperature of the main pipe 202 of the single pipe exhaust manifold 201 may be kept at a lower temperature, for example 800° C., as compared with the exhaust-gas temperature. Thus, the temperature change in the main pipe 202 never reflects directly the changes in the exhaust-gas temperature, even when the exhaust-gas temperature changes greatly from 900° C. to 700° C. In this case, the temperature change in the main pipe 202 may be smaller than the exhaust-gas temperature change of 200° C. As can be appreciated, the magnitude of thermal stress induced in the main pipe 202 of the single pipe exhaust manifold 201 may become smaller than that induced in the inner tube 108 of the thin-walled double pipe exhaust manifold 101. From the viewpoint of rapid activation of the catalytic converter employed in the exhaust system, the thin-walled double pipe exhaust manifold is superior to the single pipe exhaust manifold. However, the durability of the inner tube of the thin-walled double pipe exhaust manifold is inferior to the main pipe of the single-pipe exhaust manifold.

SUMMARY OF THE INVENTION

Accordingly, it is an object of the invention to provide an improved thin-wailed double pipe exhaust manifold which avoids the foregoing disadvantages of the prior art.

It is another object of the invention to provide an improved thin-walled double pipe exhaust manifold equipped with a high-durability inner tube advantageous to rapidly activate a catalytic converter mounted in an exhaust system of an internal combustion engine.

It is a further object of the invention to provide an improved thin-walled double pipe exhaust manifold having a superior inner tube structure according to which a concentration of thermal stress can be effectively avoided.

In order to accomplish the aforementioned and other objects of the invention, a thin-walled double pipe exhaust manifold, comprises a thin-walled main double pipe consisting of an inner tube and an outer tube, the tubes being spaced apart from each other adiabatically through an aperture defined between the tubes, a series of thin-walled branch double pipes connected to the main double pipe and consisting of an inner tube and an outer tube, the tubes being spaced apart from each other adiabatically through an aperture defined between the tubes, and relief means for relieving thermal stresses induced in the inner tube, the relief means including at least one bead portion formed at the inner tube.

According to another aspect of the invention, a thin-walled double pipe exhaust manifold for internal combustion engines, comprises a thin-walled main double pipe consisting of an inner tube and an outer tube, the tubes being spaced apart from each other adiabatically through an aperture defined between the tubes, a series of thin-walled branch double pipes connected to the main double pipe and consisting of an inner tube and an outer tube, the tubes being spaced apart from each other adiabatically through an aperture defined between the tubes, and relief means for relieving thermal stresses induced in the inner tube, the relief means including at least one bead portion formed at the inner tube. Preferably, the bead portion is formed in the vicinity of heat spots against each of which exhaust gases blow at a given inflow angle. A thickness of the inner tube is less than a thickness of the outer tube. The bead portion includes an annular raised portion having a sinusoidal waveform in cross-section, and a radius of curvature of the annular raised portion is two or more times as large as a height of ridge of the raised portion. The bead portion may include an annular bead formed on a periphery of the inner tube of the main double pipe and extending in a direction normal to a longitudinal direction of the inner tube of the main double pipe. To effectively reduce thermal stresses induced in the inner tube, it is preferable that the bead portion is provided around each heat spot, similarly to a temperature distribution of each heat spot.

DESCRIPTION OF THE PREFERRED EMBODIMENTS

Figure 1:
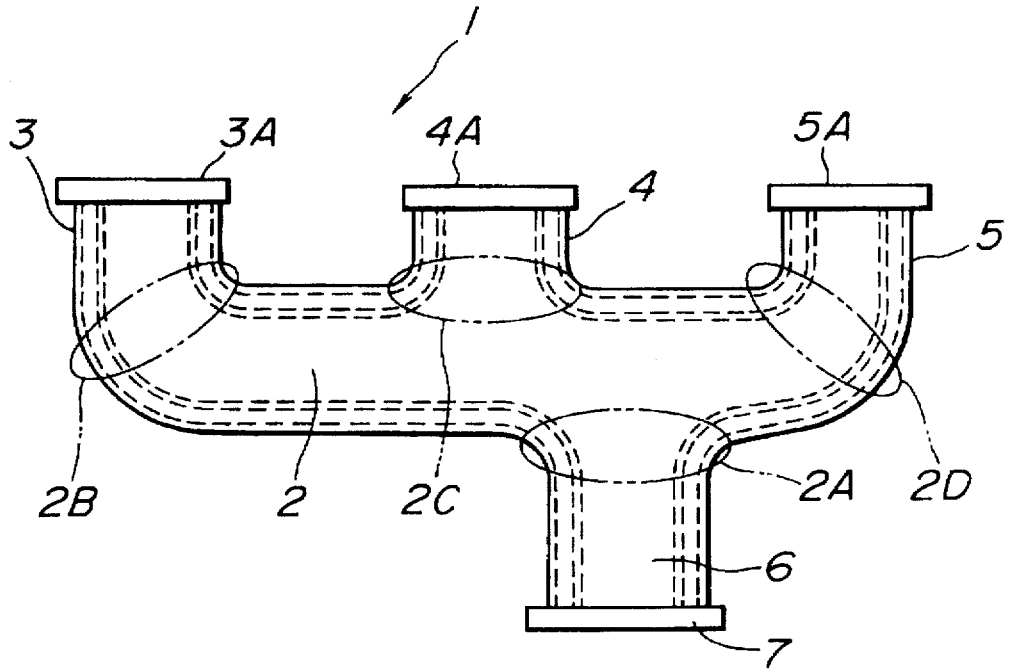
FIG. 1 is a plan view illustrating one embodiment of a thin-walled double pipe exhaust manifold according to the present invention.
Figure 3:
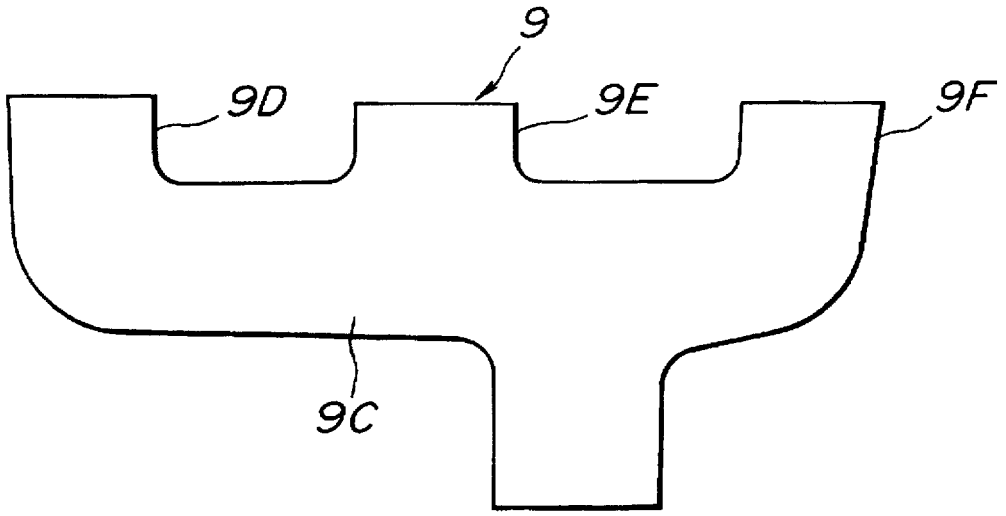
FIG. 3 is a plan view illustrating an outer tube structure of the double pipe of the thin-walled double pipe exhaust manifold of the embodiment.
Figure 4:
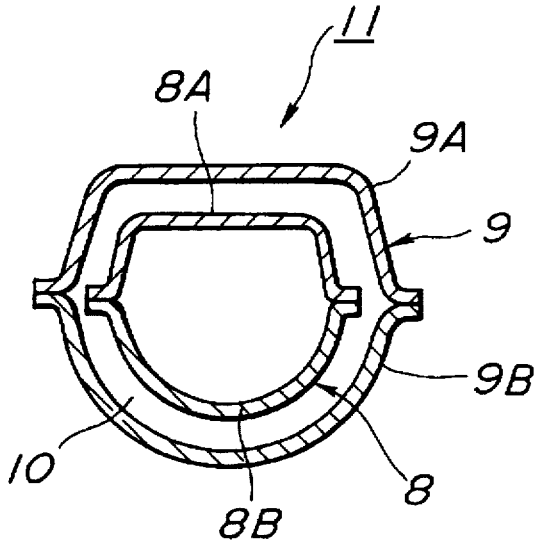
FIG. 4 is a cross-sectional view illustrating the double pipe of the thin-wailed double pipe exhaust manifold of the embodiment.

Referring now to the drawings, particularly to FIG. 1, the thin-walled double pipe exhaust manifold of the embodiment is formed of a series of interconnected thin-wailed double pipes for carrying the burned exhaust gases away from the engine cylinders. As seen in FIG. 1, the exhaust manifold of the embodiment includes a thin-walled main double pipe 2, three thin-walled branch double pipes 3, 4 and 5, and a confluent double pipe 6 connected to a junction 2A located substantially midway of the main pipe 2. The branch pipes 3, 4 and 5 are formed with respective inflow flanges 3A, 4A and 5A at their opening ends, for intercommunicating exhaust ports of the cylinder head (not shown) and exhaust-gas flow passages defined in the respective branch pipes. In the embodiment, the number of the thin-walled branch double pipes is three. As appreciated, the number of the branch pipes varies in proportion to the number of exhaust ports of the engine. The confluent pipe 6 is formed with an outflow flange 7 at its opening end, for interconnecting the exhaust pipe (not shown) and the confluent pipe 6. As best seen in FIG. 4, each of the main pipe 2 and the branch pipes 3, 4 and 5 is constructed by a double pipe 11. The double pipe 11 consists of an inner tube 8 and an outer tube 9, both tubes being spaced apart from each other adiabatically through a substantially annular aperture 10. The aperture 10 serves as an adiabatic layer. The thickness of the inner tube 8 is traditionally dimensioned as to be less than that of the outer tube 9, in consideration of rapid activation of a catalytic converter (not shown) of the exhaust system. In the embodiment, the thickness of the inner tube 8 is 0.5 mm, while the thickness of the outer tube 9 is 1.5 mm. As a result of the comparatively small thermal capacity of the inner tube 8, heat transferred from the exhaust gases to the inner tube 8 can be reduced to the minimum, thereby preventing the exhaust-gas temperature from being lowered undesiredly. The inner tube 8 consists of a pair of upper and lower halves (viewing FIG. 4), namely an upper inner shell 8A and a lower inner shell 8B. Each inner shell 8A and 8B has a pair of bent or flanged portions for the purpose of interconnecting the upper and lower shells 8A and 8B by welding. Similarly, the outer tube 9 consists of a pair of upper and lower halves, namely an upper outer shell 9A and a lower outer shell 9B. Each outer shell 9A and 9B has a pair of bent or flanged portions for the purpose of interconnecting the upper and lower shells 9A and 9B by welding. The thin-walled branch double pipes 3, 4 and 5 are formed continuously from respective junctions 2B, 2C and 2D of the main pipe 2. As clearly shown in FIG. 2, the inner tube 8 includes a main inner tube portion 8C, and three branch inner tube portions 8D, 8E and 8F, all integrally formed with the main inner tube portion 8C. As shown in FIG. 3, the outer tube 9 includes a main outer tube portion 9C, and three branch outer tube portions 9D, 9E and 9F, all integrally formed with the main outer tube portion 9C. As appreciated, the main inner tube portion 8C and the main outer tube portion 9C cooperate to construct the thin-walled main double pipe 2, whereas the branch inner tube portions 8D, 8E and 8F and the branch outer tube portions 9D, 9E and 9F cooperate to construct the thin-walled branch double pipes 3, 4 and 5.

Figure 2:
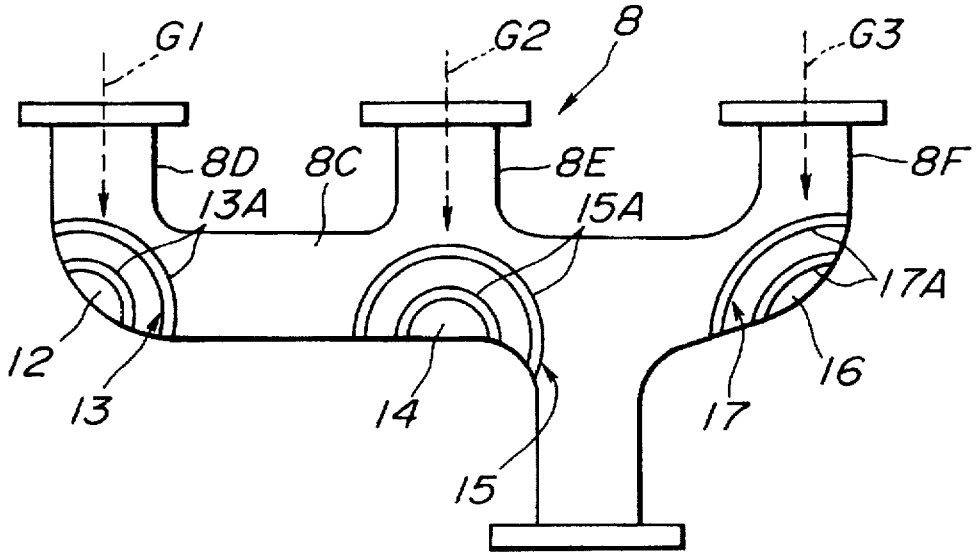
FIG. 2 is a plan view illustrating an inner tube structure of a double pipe of the thin-walled double pipe exhaust manifold of the embodiment shown in FIG. 1.
Figure 5:
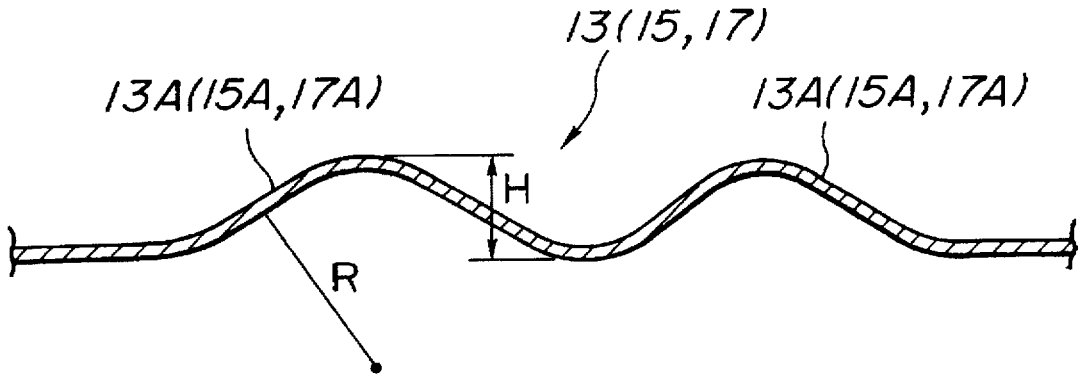
FIG. 5 is an enlarged cross-sectional view illustrating a bead portion of the inner tube shown in FIG. 2.

As seen in FIG. 2, when exhaust gases pass into the three thin-walled branch double pipes 3, 4 and 5, thermal stresses tend to develop greatly at three heat spots at which the exhaust gases are brought into direct contact with the inner wall sections of the respective branch pipes 3, 4 and 5. The first heat spot 12 is created at a wall section against which exhaust gases G1 entering the branch inner tube portion 8D blow at a given inflow angle, the second heat spot 14 is created at a wall section against which exhaust gases G2 entering the branch inner tube portion 8E blow at a given inflow angle, and the third heat spot 16 is created at a wall section against which exhaust gases G3 entering the branch inner tube portion 8F blow at a given inflow angle. The above-noted double pipe structure of the thin-walled double pipe exhaust manifold of the embodiment is similar to that of the conventional thin-walled double pipe exhaust manifold. As shown in FIG. 2, the inner tube 8 incorporated in the thin-walled double pipe exhaust manifold made according to the invention also includes bead portions 13, 15 and 17 formed by bearing. The first bead portion 13 is integrally formed with the inner tube 8 around the first heat spot 12 in a manner so as to surround the first heat spot. The second bead portion 15 is integrally formed with the inner tube 8 around the second heat spot 14 in a manner so as to surround the second heat spot. The third bead portion 17 is integrally formed with the inner tube 8 in a manner so as to surround the third heat spot. The first bead portion 13 is formed of two annular raised portions 13A, each having a sinusoidal waveform in cross-section, formed around the first heat spot 12 such that the two annular raised portions 13A are provided similarly to the temperature distribution of the first heat spot 12 of the inner tube 8. The second bead portion 15 is formed of two sinusoidal-wave like annular raised portions 15A formed around the second heat spot 14 such that the two annular raised portions 15A are provided similarly to the temperature distribution of the second heat spot 14 of the inner tube 8. Likewise, the third bead portion 17 is formed of two sinusoidal-wave like annular raised portions 17A formed around the third heat spot 16 such that the two annular raised portions 17A are provided similarly to the temperature distribution of the third heat spot 16 of the inner tube 8. As explained above, since each of the three bead portions 13, 15 and 17 is provided similarly to the temperature distribution of the corresponding heat spot of the inner tube 8, thermal deformation or distortion at each bead portion becomes uniform. As a consequence, this prevents undesirable thermal stresses from developing at the respective heat spots. Referring now to FIG. 5, the cross-section of each bead portion is so designed that the radius R of curvature of the sinusoidal-wave like annular raised portion 13A, 15A and 17A of each bead portion is two or more times as large as the height H of the ridge of the annular raised portion, and thus the magnitude of thermal stress per unit-area at each bead portion is reduced. Additionally, the concentration of thermal stresses can be avoided effectively. In case of the thin-walled double pipe incorporating the inner tube formed with bead portions, the thermal-stress concentration was reduced approximately to the half degree as compared with the conventional thin-walled double pipe exhaust manifold with the inner tube not including bead portions. This was experimentally assured by the inventors of the present invention.

During off-idle operation or medium- or high-speed operation, high-temperature exhaust gases blow against the first, second and third heat spots 12, 14 and 16 of the inner tube 8 of the double pipe 11, thereby resulting in temperature-rise at each heat spot 12, 14 and 16 and in the vicinity of each heat spot. During idling or low-speed operation, low-temperature exhaust gases blow against the first, second and third heat spots 12, 14 and 16, thereby resulting in temperature-drop at and near the respective heat spots. In this manner, owing to changes in temperature of exhaust gases flowing through the inner tube 8, resulting from repetition of idling operation and off-idling operation, thermal stresses tend to repeatedly occur locally at the respective heat spots 12, 14 and 16. In response to the exhaust-gas temperature changes, the first, second and third bead portions 13, 15 and 17 expand and contract thermally. A great amount of thermal stresses induced in the heat spots 12, 14 and 16 are transferred to the respective bead portions 13, 15 and 17, with the result that the thermal stresses induced in each heat spot are reduced or relieved effectively. As will be appreciated from the above, in spite of thermal changes in exhaust gases resulting from repetition of idling operation and off-idling operation, high localized thermal stresses can be reduced effectively, by way of thermal expansion and contraction of the bead portions. This enhances the durability of the thin-walled double pipe exhaust manifold 1.

Figure 6:
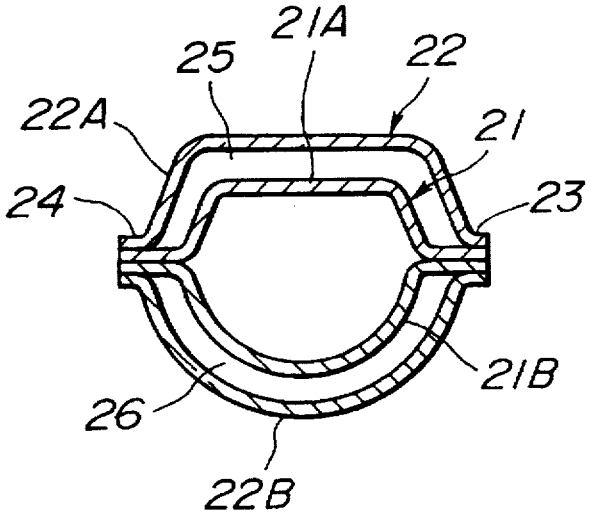
FIG. 6 is a cross-sectional view illustrating a modification of the double pipe of the thin-walled double pipe exhaust manifold according to the invention.

FIG. 6 shows a modification of the double pipe of the thin-walled double pipe exhaust manifold. The double pipe of this modification is different from the double pipe 11 shown in FIG. 4 in that two opposing pairs of flanged portions of the inner tube 21 of the modified double pipe are engaged with two pairs of flanged portions of the outer tube 22 such that one pair of flanged portions of the inner tube 21 are sandwiched between the corresponding one pair of flanged portions of the outer tube 22. As seen in FIG. 6, in the double pipe of the modification, the inner tube 21 consists of an upper inner shell 21A and a lower inner shell 21B, while the outer tube 22 consists of an upper outer shell 22A and a lower outer shell 22B. The two opposing flanged portions of the upper and lower inner shells 21A and 21B are rigidly connected by welding. The respective shells of the outer tube 22 are fixedly connected onto the two pairs of flanged portions of the inner tube 21 by way of welding, in such a manner that one welded pair of flanged portions of the inner tube 21 is sandwiched between one pair of flanged portions 23 of the outer tube 22, and the other welded pair of flanged portions of the inner tube is sandwiched between the other pair of flanged portions 24 of the outer tube. As clearly seen in FIG. 6, a substantially semi-circular aperture 25 is thus defined between the upper outer shell 22A and the upper inner shell 21A. A substantially semi-circular aperture 26 is also defined between the lower outer shell 22B and the lower inner shell 21B. In case of the modified double pipe shown in FIG. 6, the two pairs of flanged portions of the inner shells 21A and 21B serve as connecting members for rigid connection between the inner and outer tubes 21 and 22. It can be appreciated that the modulus of section of the double pipe shown in FIG. 6 is greater, as compared with the double pipe 11 shown in FIG. 4. Thus, the double pipe shown in FIG. 6 has a higher rigidity than the double pipe shown in FIG. 4.

In the previously-explained embodiment, although each bead portion 13, 15 and 17 consists of two sinusoidal-wave like annular raised portions, each bead portion may consist of at least one annular raised portion, for example one, or three or more annular raised portions.

Figure 8:
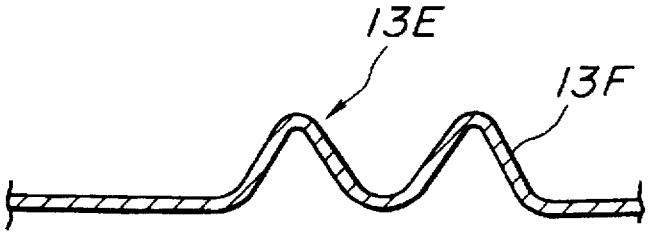
FIG. 8 is an enlarged cross-sectional view illustrating a modification of the bead portion of the inner tube of the double pipe constructing the thin-walled double pipe exhaust manifold of the invention.
Figure 9:
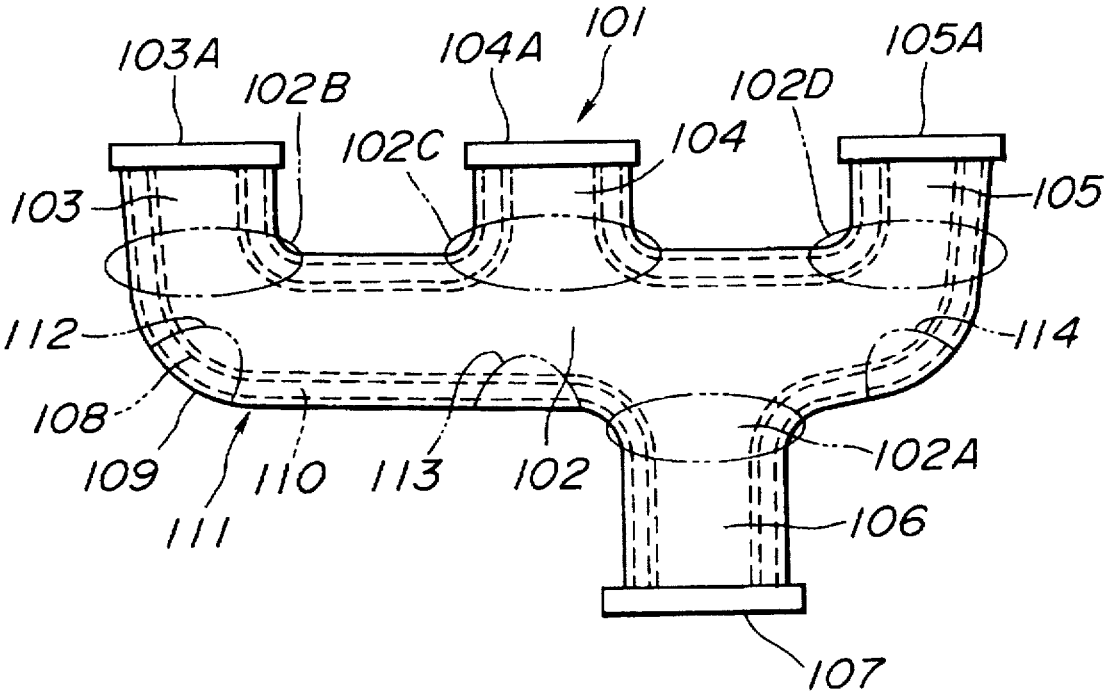
FIG.9 (PRIOR ART)
FIG. 9 is a plan view illustrating a prior art thin-walled double pipe exhaust manifold.
Figure 10:
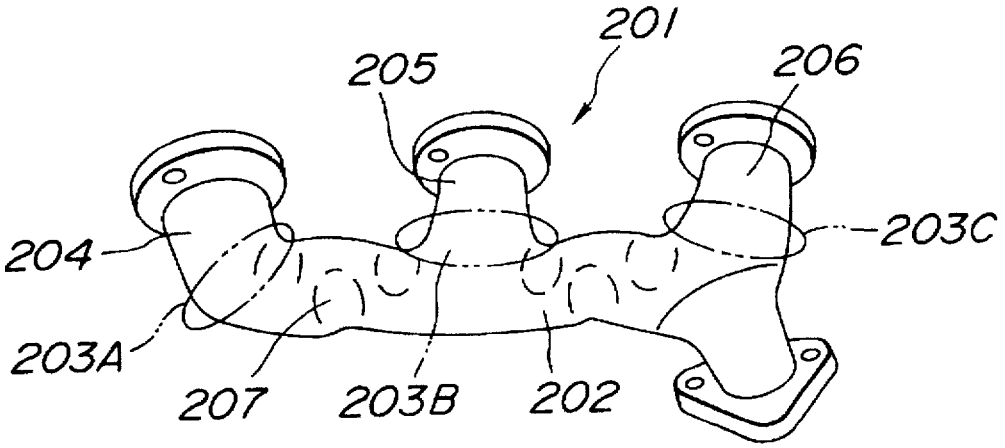
FIG.10 (PRIOR ART)
FIG. 10 is a schematic perspective view illustrating a prior art single pipe exhaust manifold.

Although the cross-section of each bead portion of the inner tube of the thin-walled double pipe exhaust manifold of the embodiment is so designed that the radius R of curvature of the sinusoidal-wave like annular raised portion 13A, 15A and 17A of each bead portion is two or more times as large as the height H of the moderately sloped ridge of the annular raised portion, the annular raised portion of each bead portion may have a steeply sloped ridge, as shown in FIG. 8. The bead portion 13E illustrated in FIG. 8 consists of the annular raised portions 13F having steep ridges. In this case, the pitch from one ridge to the adjacent ridge becomes shorter. That is, the number of bead portions per unit-area on the inner tube can be effectively increased. As the number of bead portions is increased, thermal stresses induced in each heat spot are reduced more effectively by way of thermal expansion and contraction of a large number of bead portions.

Furthermore, although the thickness of the inner tube 8 is set at 0.5 mm and the thickness of the outer tube 9 is set at 1.5 mm, the dimension of the aperture 10 as well as the thicknesses of the inner and outer tubes 8 and 9 must be properly designed in consideration of the engine performance.

Figure 7:
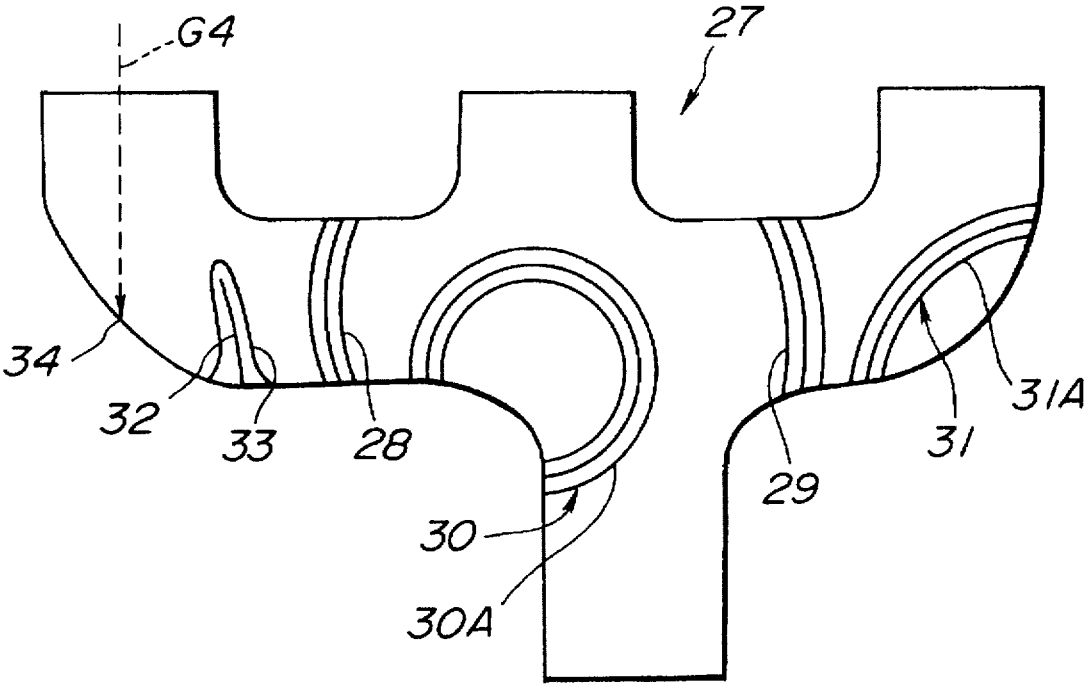
FIG. 7 is a plan view illustrating a modification of the inner tube structure of the double pipe constructing the thin-walled double pipe exhaust manifold according to the invention.

Moreover, the inner tube 27 shown in FIG. 7 may be used in place of the inner tube 8 shown in FIG. 2. Referring now to FIG. 7, the inner tube 27 is formed with annular bead portions 28 and 29 extending in a direction perpendicular to the longitudinal direction of its main double pipe, so as to facilitate thermal expansion or contraction in the longitudinal direction of the main double pipe of the inner tube 27. The annular bead portions 28 and 29 are advantageous to wholly reduce the magnitude of thermal stresses induced in the inner tube 27.

As previously explained, the thermal stress concentration with high localized stresses generally tends to occur at heat spots against which exhaust gases blow strongly in the prolongation of a stream line of the incoming exhaust gases entering each branch pipe. Often, the point of the high localized thermal stress would be slightly offset from each given heat spot, owing to heat transfer resulting from exhaust gas flow. For instance, as shown in FIG. 7, a thermal strain or distortion absorbing region 32 may be often formed slightly downstream of the usual heat spot 34 against which exhaust gases G4 blow directly at a given inflow angle. This results from offsetting of the heat spot to the downstream direction due to heat transfer caused by exhaust-gas flow and from machining distortion of the inner tube 27, remaining therein in the form of residual stresses. In such a case, a bead portion must be formed in the thermal strain absorbing region 32 in order to effectively absorb thermal strains and to reduce thermal stresses. As seen in FIG. 7, an elongated bead portion, which is partially formed in the thermal strain absorbing region 32, may be advantageous to more effectively reduce thermal stresses and an additional stress caused by combination of the thermal strain and the mechanical strain created by residual stresses remaining in the inner tube.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

The shape and dimensions of bead portions are not limited to the previously-noted embodiment. As can be appreciated from bead portions 30 and 31 with respective annular raised portions 30A and 31A illustrated in FIG. 7, bead portions may be properly provided and modified in consideration of a shape or size of an exhaust manifold, a region of residual stresses caused by machining strain, and true heat spots depending on heat transfer resulting from exhaust-gas flow.

What is claimed is:

1. A thin-walled double pipe exhaust manifold for internal combustion engines, comprising:

a thin-walled main double pipe including an inner tube and an outer tube, said tubes being spaced apart from each other adiabatically through a space defined between said tubes;

a plurality of thin-walled branch pipes connected to said main double pipe and including an inner tube and an outer tube, said tubes being spaced apart from each other adiabatically through a space defined between said tubes; and relief means for relieving thermal stresses induced in said inner tube, said relief means including at least one bead portion formed at said inner tube;

wherein said bead portion formed in the vicinity of heat spots against each of which exhaust gases blow at a given inflow angle.

2. The exhaust manifold as claimed in claim 1, wherein a thickness of said inner tube is less than a thickness of said outer tube.

3. The exhaust manifold as claimed in claim 1, wherein said bead portion includes an annular bead having a raised portion with a sinusoidal waveform in cross-section, and wherein a radius of curvature of said raised portion is two or more times as large as a height of said raised portion.

4. The exhaust manifold as claimed in claim 1, wherein said bead portion is shaded around each of said heat spots to correspond with a temperature distribution of each of said heat spots.

5. A thin-walled double pipe exhaust manifold for internal combustion engines, comprising:

an inner tube and an outer tube, said tubes being spaced apart from each other adiabatically through a space defined between said tubes, said inner tube having a main tube section and a plurality of input branches, wherein exhaust gases are blown into the main tube section through the input branches and form heat spots along the main tube section at points along the main tube section against which the exhaust gases blow as the exhaust gases exit the input branches and enter the main tube section, and wherein the main tube section includes at least one bead portion at one of the heat spots.

6. The exhaust manifold as claimed in claim 5, wherein a thickness of said inner tube is less than a thickness of said outer tube.

7. The exhaust manifold as claimed in claim 5, wherein said bead portion includes an annular bead having a raised portion with a sinusoidal waveform in cross-section, and wherein a radius of curvature of said raised portion is at least two times as large as a height of said raised portion.

8. The exhaust manifold as claimed in claim 5, wherein the main tube section includes at least one bead portion at each of the heat spots.

9. The exhaust manifold as claimed in claim 8, wherein said at least one bead portion at each of the heat spots does not extend completely around the circumference of the main tube section.

10. The exhaust manifold as claimed in claim 5, wherein the at least one bead portion at one of the heat spots does not extend completely around the circumference of the main tube section.

11. The exhaust manifold as claimed in claim 5, wherein said bead portion is shaped around said one of the heat spots to correspond with a temperature distribution of said one of the heat spots.

* * * * *